US009483902B2

(12) United States Patent
Hadida

(10) Patent No.: US 9,483,902 B2
(45) Date of Patent: Nov. 1, 2016

(54) SYSTEMS, METHODS, AND MEDIA FOR IMMERSIVE ROULETTE GAMING

(71) Applicant: Evolution Malta Ltd, St. Julians (MT)

(72) Inventor: Richard Hadida, Monaco (MC)

(73) Assignee: Evolution Malta Ltd, St. Julians (MT)

( * ) Notice: Subject to any disclaimer, the term of this patent is extended or adjusted under 35 U.S.C. 154(b) by 0 days.

(21) Appl. No.: 14/304,440

(22) Filed: Jun. 13, 2014

(65) Prior Publication Data

US 2014/0370957 A1 Dec. 18, 2014

Related U.S. Application Data

(60) Provisional application No. 61/834,599, filed on Jun. 13, 2013.

(51) Int. Cl.
*A63F 5/00* (2006.01)
*G07F 17/32* (2006.01)

(52) U.S. Cl.
CPC ..... *G07F 17/3211* (2013.01); *A63F 5/00* (2013.01); *G07F 17/32* (2013.01); *G07F 17/323* (2013.01); *G07F 17/326* (2013.01); *G07F 17/3241* (2013.01); *G07F 17/3286* (2013.01)

(58) Field of Classification Search
CPC ..... A63F 5/00; A63F 2009/2435; A63F 2003/083
USPC ..... 463/16–17, 22; 273/138.1, 142 E
See application file for complete search history.

(56) References Cited

U.S. PATENT DOCUMENTS 4,357,015 A * 11/1982 Santora et al. ..... 463/22
5,762,552 A 6/1998 Vuong et al.
5,770,533 A 6/1998 Franchi
5,801,766 A * 9/1998 Alden ..... 348/157
5,836,583 A * 11/1998 Towers ..... 273/142 B
6,575,834 B1 * 6/2003 Lindo ..... 463/40
6,755,741 B1 6/2004 Rafaeli
7,997,984 B2 8/2011 Morgan et al.

(Continued)

FOREIGN PATENT DOCUMENTS

WO WO/95/28996 11/1995
WO WO/01/52957 7/2001

(Continued)

OTHER PUBLICATIONS

Examination Report dated Jan. 25, 2016 in European Patent Application No. 14172419.5.

*Primary Examiner* — Jason Skaarup
*Assistant Examiner* — Alex F. R. P Rada, II
(74) *Attorney, Agent, or Firm* — Byrne Poh LLP

(57) ABSTRACT

In accordance with some embodiments of the disclosed subject matter, methods, systems, and media for immersive roulette gaming are provided. In accordance with some embodiments of the disclosed subject matter, methods for roulette gaming are provided, the methods comprise: receiving video data from a plurality of image sensors; detecting a ball on a roulette wheel based on the video data using a hardware processor; obtaining motion data about the ball based on the video data using the hardware processor; determining whether the ball is about to fall into a pocket of the roulette wheel based on the video data using the hardware processor; and producing multiple slow-motion images of the ball in response to determining that the ball is about to fall into a pocket on the roulette wheel.

15 Claims, 8 Drawing Sheets

(56) References Cited

U.S. PATENT DOCUMENTS

| | | | | |
|---|---|---|---|---|
| 8,025,569 | B2 | 9/2011 | Nguyen et al. | |
| 8,088,010 | B1 | 1/2012 | Hill | |
| 8,152,641 | B2 | 4/2012 | Hill | |
| 8,182,326 | B2 | 5/2012 | Speer, II et al. | |
| 8,419,529 | B2 | 4/2013 | Watanabe | |
| 8,480,471 | B2 | 7/2013 | Lutnick et al. | |
| RE44,439 | E | 8/2013 | Rafaeli | |
| 8,641,515 | B2 | 2/2014 | Nicely et al. | |
| 8,657,657 | B2 | 2/2014 | Watanabe | |
| 2002/0094869 | A1 | 7/2002 | Harkham | |
| 2002/0151363 | A1 | 10/2002 | Letovsky et al. | |
| 2003/0060263 | A1* | 3/2003 | Pearce et al. | 463/17 |
| 2003/0125109 | A1* | 7/2003 | Green | 463/29 |
| 2009/0174141 | A1* | 7/2009 | Witty | 273/142 E |
| 2009/0176547 | A1 | 7/2009 | Katz | |
| 2011/0003632 | A1* | 1/2011 | Ansari et al. | 463/25 |
| 2011/0159965 | A1 | 6/2011 | Chun | |
| 2011/0275432 | A1* | 11/2011 | Lutnick | G07F 17/3232 463/25 |
| 2012/0276968 | A1 | 11/2012 | Watanabe | |
| 2013/0165235 | A1 | 6/2013 | Chun | |
| 2013/0196777 | A1 | 8/2013 | Hill | |
| 2013/0281188 | A1 | 10/2013 | Guinn et al. | |
| 2013/0288764 | A1 | 10/2013 | Chun | |
| 2014/0038141 | A1 | 2/2014 | Burza et al. | |

FOREIGN PATENT DOCUMENTS

| | | |
|---|---|---|
| WO | WO/01/86604 | 11/2001 |
| WO | WO/2013/068712 | 5/2013 |

* cited by examiner

300

400

600

SYSTEMS, METHODS, AND MEDIA FOR IMMERSIVE ROULETTE GAMING

CROSS-REFERENCE TO RELATED APPLICATION

This application claims the benefit of U.S. Provisional Patent Application No. 61/834,599, filed Jun. 13, 2013, which is hereby incorporated by reference herein in its entirety.

TECHNICAL FIELD

The disclosed subject matter relates to systems, methods, and media for immersive roulette gaming.

BACKGROUND

In a roulette game, players may choose to place bets on either a single number or a range of numbers, the colors red or black, or whether the number is odd or even. To determine the winning number and color, a dealer spins a wheel in one direction, then spins a ball in the opposite direction around a tilted circular track running around the circumference of the wheel. The ball falls onto the wheel and into a colored and numbered pockets on the wheel when the ball loses momentum.

SUMMARY

In accordance with some embodiments of the disclosed subject matter, methods, systems, and media for immersive roulette gaming are provided.

In accordance with some embodiments of the disclosed subject matter, methods for immersive roulette gaming are provided, the methods comprising: receiving video data from a plurality of image sensors; detecting a ball on a roulette wheel based on the video data using a hardware processor; obtaining motion data about the ball based on the video data using the hardware processor; determining whether the ball is about to fall into a pocket of the roulette wheel based on the video data using the hardware processor; and producing multiple slow-motion images of the ball in response to determining that the ball is about to fall into a pocket on the roulette wheel.

In accordance with some embodiments of the disclosed subject matter, systems for immersive roulette gaming are provided, the systems comprising: at least one hardware processor that is configured to: receive video data from a plurality of image sensors; detect a ball on a roulette wheel based on the video data; obtain motion data about the ball based on the video data; determine whether the ball is about to fall into a pocket of the roulette wheel based on the video data; and produce multiple slow-motion images of the ball in response to determining that the ball is about to fall into a pocket on the roulette wheel.

In accordance with some embodiments of the disclosed subject matter, non-transitory media containing computer-executable instructions that, when executed by a processor, cause the processor to perform a method for immersive roulette gaming are provided. In some embodiments, the method comprises: receiving video data from a plurality of image sensors; detecting a ball on a roulette wheel based on the video data; obtaining motion data about the ball based on the video data; determining whether the ball is about to fall into a pocket of the roulette wheel based on the video data; and producing multiple slow-motion images of the ball in response to determining that the ball is about to fall into a pocket on the roulette wheel

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

DETAILED DESCRIPTION

Figure 1:
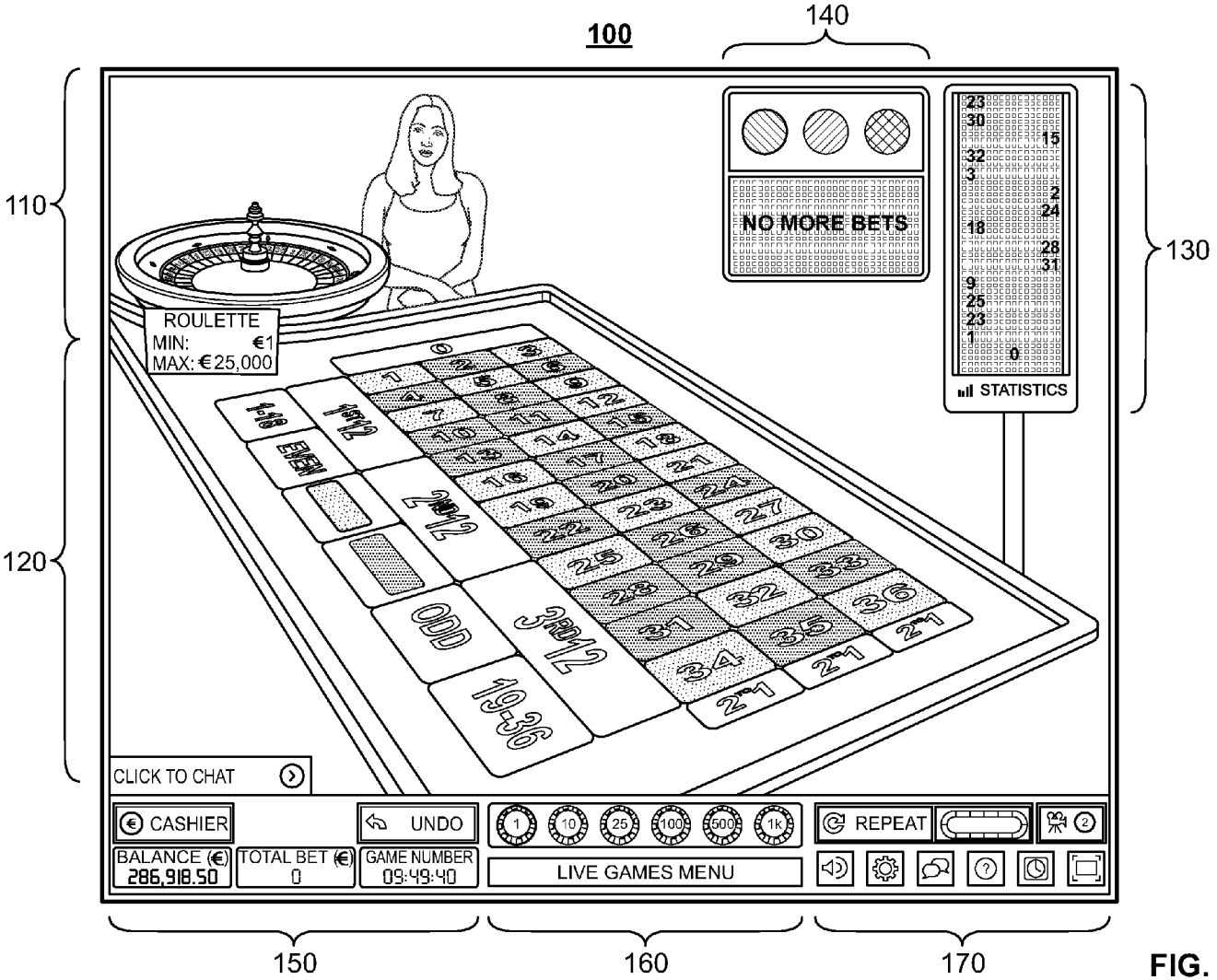
FIG. 1 shows an example of a user interface for prompting a user to participate in an immersive roulette game in accordance with some embodiments of the disclosed subject matter.

In accordance with some embodiments, mechanisms (e.g., including methods, systems, computer readable media, etc.) for immersive roulette gaming are provided. Generally speaking, these mechanisms can be implemented using multiple cameras, a server, one or more user device (e.g., such as a laptop computer, a desktop computer, a tablet computer, a mobile phone, etc.), etc.

In some embodiments, a suitable network connection can be established between a user device and the server. For example, a user can enter a uniform resource locator (URL) corresponding to the web address of the server using the user device (e.g., using a suitable browser displayed by the user device, etc.). As another example, the user can enter a URL corresponding to a web address that can redirect the user device to the web address of the server. A suitable connection can then be established between the user device and the server through a suitable network (e.g., such as the Internet, etc.).

In some embodiments, one or more suitable cameras can be used to monitor an area of a studio (or a casino, etc.) including a roulette table, a roulette wheel, a dealer, etc. For example, multiple cameras can be used to monitor the area and produce suitable video data and/or audio data about the area or any suitable portions of the area. In a more particular example, each of the cameras can have a suitable field of view (FOV) that can cover a portion of the area and can produce video data (e.g., still images, moving images, etc.), audio data, etc. of the objects within the FOV. The cameras can be arranged so that the combination of the FOVs of the cameras can cover the whole area.

In some embodiments, the cameras can continuously produce suitable video data, audio data, etc. during a roulette game session. The video data, audio data, etc. can be transmitted to the server. The server can then transmit the video data, audio data, etc. to one or more user devices.

In some embodiments, during the roulette game session, the mechanisms can detect the presence of a ball spinning on a roulette wheel and track the movement of the ball using one or more suitable cameras. In some embodiments, the mechanisms can also detect the moment when the ball is about to drop into a pocket on the roulette wheel. For example, the mechanisms can obtain motion data about the movement of the ball based on the video data produced by the cameras. The mechanisms can then estimate the velocity of the ball at a particular instant. In some embodiments, the mechanisms can determine that the ball is about to drop into a pocket on the roulette wheel when the magnitude of the velocity of the ball (e.g., the speed of the ball) is less than a suitable threshold.

In some embodiments, in response to determining that the ball is about to drop into a pocket on the roulette wheel, the mechanisms can receive suitable video data about the spinning ball and add one or more suitable video effects, audio effects, etc. to the video data. For example, the mechanisms can direct one or more cameras to take slow-motion images of the ball by operating at a high-speed mode and taking moving images at a high rate (e.g., a rate higher than that the moving images will be played back). As another example, the mechanisms can apply suitable mood lighting effects, chromakey effects, etc. to the video data to add dramatic effects to the movement of the ball. As yet another example, the mechanisms can add suitable audio effects, such as sounds of the movement of the ball, suitable music, etc. to enhance the user's game experience.

In some embodiments, a user device can receive video data, audio data, etc. relating to a roulette game session transmitted from the server in a real-time manner. The user device can then cause the video data, audio data, etc. to be rendered (e.g., by displaying the video data, playing the audio data, etc.). In some embodiments, the user device can also allow the user to participate in a live roulette game session. For example, the user device can present multiple user interfaces to allow the user to play a bet, select a roulette table, view information about the roulette session, etc. in a real-time manner.

These and other features for immersive roulette gaming are described herein by way of the examples shown in FIGS. 1-8.

In some embodiments, a user device can present multiple interfaces to a user to allow the user to participate in an immersive roulette game. For example, as shown in FIG. 1, an interface 100 can be presented to the user to prompt the user to place a bet. As shown, interface 100 can include display areas 110, 120, 130, and 140, in which suitable video content can be rendered.

As illustrated, interface 100 can present video content (e.g., moving images, still images, etc.) showing a dealer and a roulette wheel in display area 110. Any suitable video content can be presented. For example, the user device can cause video data (e.g., including moving images, etc.) transmitted from a server to be displayed in display area 110. In a more particular example, the video data can be generated by one or more cameras that are monitoring one or more areas of a casino or a studio in which a roulette game session can be held (e.g., an area including a roulette table, a roulette wheel, a dealer, etc.).

As shown, interface 100 can also present a roulette table in display area 120 to provide the user with various betting options. For example, the user can select a pocket of the roulette wheel in which the user hopes the ball will land by selecting a number on the roulette table in area 120 that corresponds to the pocket. As another example, the user can place a bet on a range of pockets of the roulette wheel by selecting a range of numbers on the roulette table in area 120 that correspond to the range of the pockets (e.g., such as "1st 12," "second 12," "3rd 12," etc.). As yet another example, the user can place a bet on a particular color (e.g., the red color, the black color, etc.) by selecting the particular color on the roulette table in area 120. As yet another example, the user can place a bet on an odd number or an even number by selecting "ODD" or "EVEN" on the roulette table in area 120, respectively.

In some embodiments, interface 100 can allow the user to set the value of the bet(s) in a suitable manner. For example, the user can select a chip provided in menu 160 that has a suitable value to set the value of the bet. In some embodiments, the user can also drag the selected chip to the roulette table in area 120 to place a bet and set the bet value. More particularly, for example, the user can drag the selected chip to a particular portion of the roulette table (e.g., such as a number on the roulette table, a range of number on the roulette table, a color, etc.) to place a bet on the particular portion.

In some embodiments, the user device can present suitable statistics of a current roulette game session and/or previous roulette game sessions in display area 130 of interface 100, such as the winning numbers of the previous roulette sessions, the hot and cold numbers relating to the previous roulette sessions, etc.

In some embodiments, the user device can present suitable warning information using interface 100. For example, a message can be displayed in area 140 to inform the user that no more bets can be placed for the current roulette game session.

In some embodiments, the user device can provide the user with suitable information about the user's account using interface 100. For example, in area 150, information about the balance(s) of the user's account, the amount of bets that have been placed by the user in one or more game sessions, and any other suitable information can be presented to the user.

In some embodiments, the user device can also provide the user with multiple game options using menu 170 on interface 100. For example, the user can communicate with other players and/or the dealer by sending, reviewing, and/or receiving suitable messages using a chat button of menu 170. As another example, the user can change multiple game setting options (e.g., such as the volume of the sound, the brightness of the display, etc.) using menu 170.

In some embodiments, in response to one or more users placing bets, a roulette session can begin (e.g., by causing a ball to begin spinning around a roulette wheel). During the roulette session, the user device can present one or more suitable interfaces to the user to allow the user to have an immersive game experience. For example, the user device can cause suitable video content showing the ball spinning around the roulette wheel, the bets placed by multiple users, etc. to be displayed in display areas 110 and 120 of FIG. 1.

In some embodiments, the user device can allow the user to continue to place bets (e.g., using an interface similar to interface 100 of FIG. 1) after the roulette session starts (e.g., after the ball starts spinning around the roulette wheel). In some embodiments, the user device can prevent the user from placing new bets by announcing "no more bets." For example, as shown in FIG. 1, the user device can present a message in display area 140 to inform the user that no bets are allowed to be placed any more.

Figure 2:
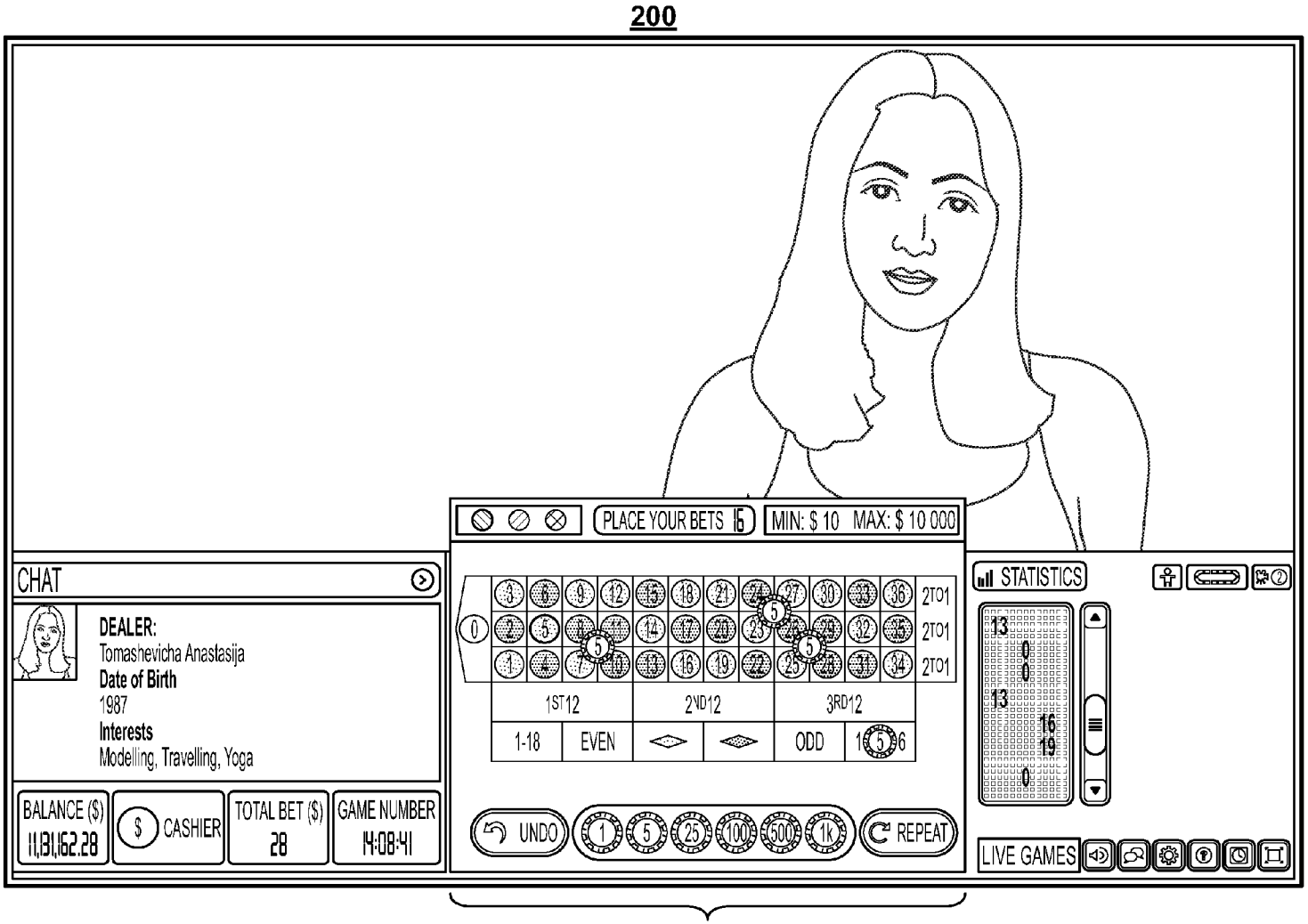
FIG. 2 shows an example of a user interface for prompting a user to participate in a live roulette game in accordance with some embodiments of the disclosed subject matter.

In some embodiments, the user device can present multiple interfaces to the user to allow the user to participate in a live roulette session. For example, as illustrated in FIG. 2, the user device can present an interface 200 to the user to prompt the user to join a live roulette session. The user can be prompted to join the live roulette session in any suitable manner. For example, the user device can cause suitable video content (e.g., moving images of a dealer, a roulette wheel, a roulette table, etc.) and audio content (e.g., voice of the dealer) to be rendered using interface 200. In a more particular example, one or more suitable cameras can be used to monitor an area including the dealer, the roulette table, the roulette wheel, etc. The cameras can then produce video data and audio data when the dealer conducts a roulette game (e.g., by announcing that the user can place a bet, etc.) in a suitable manner. The video data and audio data can be transmitted to the user device from a server via a suitable network (e.g., an Internet network, etc.). The user device can then cause the video data to be displayed on interface 200 and cause the audio data to be played back.

As shown, interface 200 can also include a roulette table 202 that can allow the user to place a bet in the live roulette session. The user can be allowed to place the bet in any suitable manner. For example, the user can select a chip on roulette table 202 that corresponds to a desired value of the bet to be placed. The user can then drag the selected chip to a portion of roulette table to place a bet. In a more particular example, the user can place a bet on a pocket of the roulette wheel in which the user hopes the ball will land by dragging the selected chip to a number on roulette table 202 that corresponds to the pocket. As another example, the user can place a bet on a range of pockets of the roulette wheel by dragging the selected chip to a range of numbers on roulette table 202 that correspond to the range of the pockets (e.g., such as "1$^{st}$ 12," "second 12," "3$^{rd}$ 12," etc.). As yet another example, the user can place a bet on a particular color (e.g., the red color, the black color, etc.) by dragging the selected chip to the particular color on roulette table 202. As still another example, the user can place a bet on an odd number or an even number by dragging the selected chip to the "ODD" portion or the "EVEN" portion of roulette table 202, respectively.

In some embodiments, interface 200 can also include any suitable information about the dealer conducting the roulette session (e.g., such as the name of the dealer, a picture of the dealer, a description of the dealer, etc.), statistics of previous roulette sessions (e.g., winning numbers of multiple recent roulette sessions), information about other players who are participating in the roulette session (e.g., such as the names of the users, the bets that have been placed by the users), and/or any other suitable information that can allow the user to have an immersive game experience.

In some embodiments, the dealer can start a live roulette session by spinning a wheel in one direct and spinning a ball in the opposite direction around a tilted circular track running around the circumference of the wheel. In some embodiments, the cameras can continuously monitor the area including the dealer, the roulette wheel, etc. Video data (e.g., such as moving images of the dealer, the roulette wheel, the spinning ball, etc.), audio data, etc. relating to the live roulette session can be transmitted to the user device in a real-time manner. The user device can then cause the video data, audio data, etc. transmitted from the server to be rendered to allow the user to have an immersive game experience.

Figure 3:
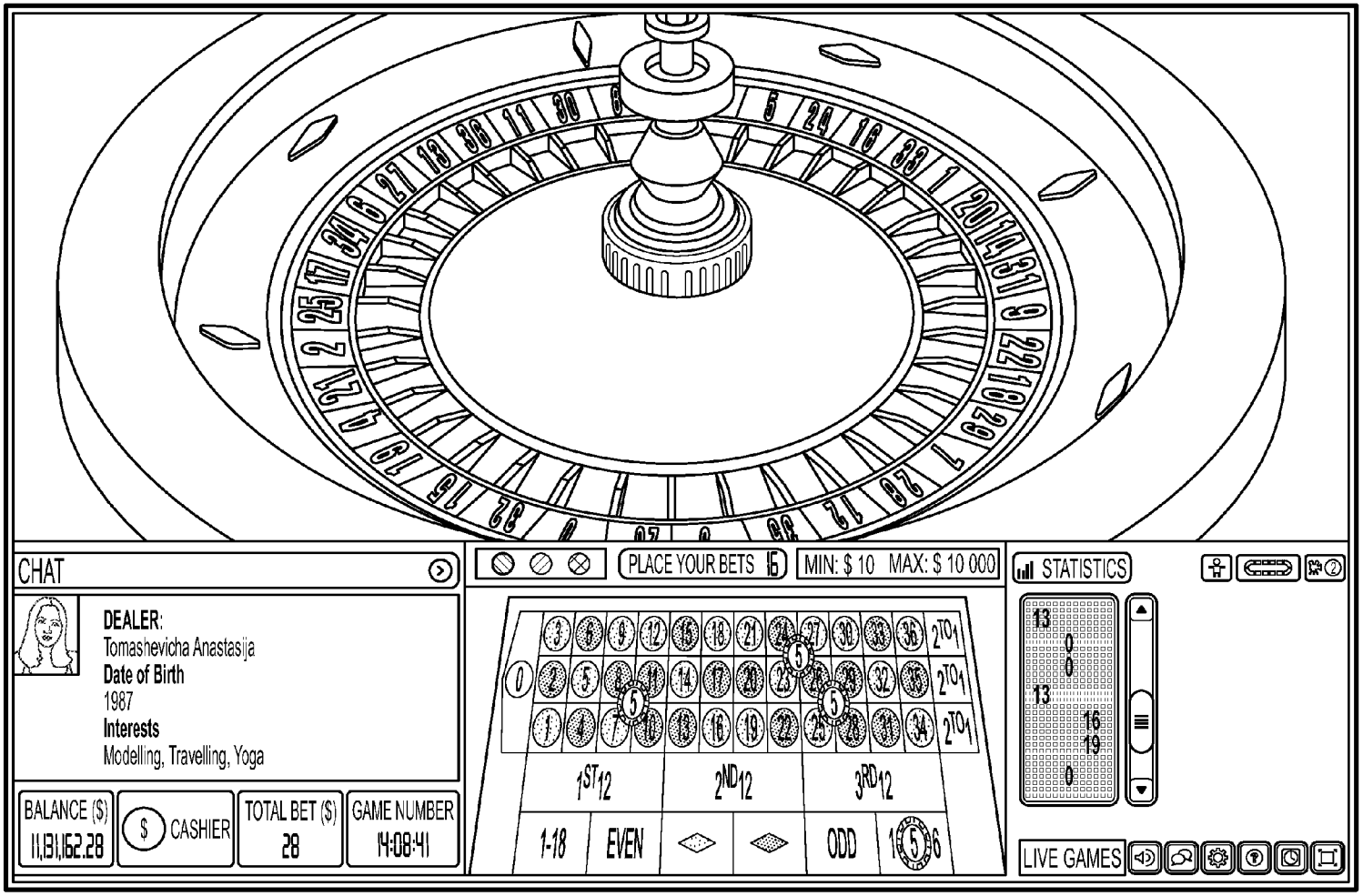
FIG. 3 shows an example of a user interface for presenting information about a roulette session in accordance with some embodiments of the disclosed subject matter.
Figure 4:
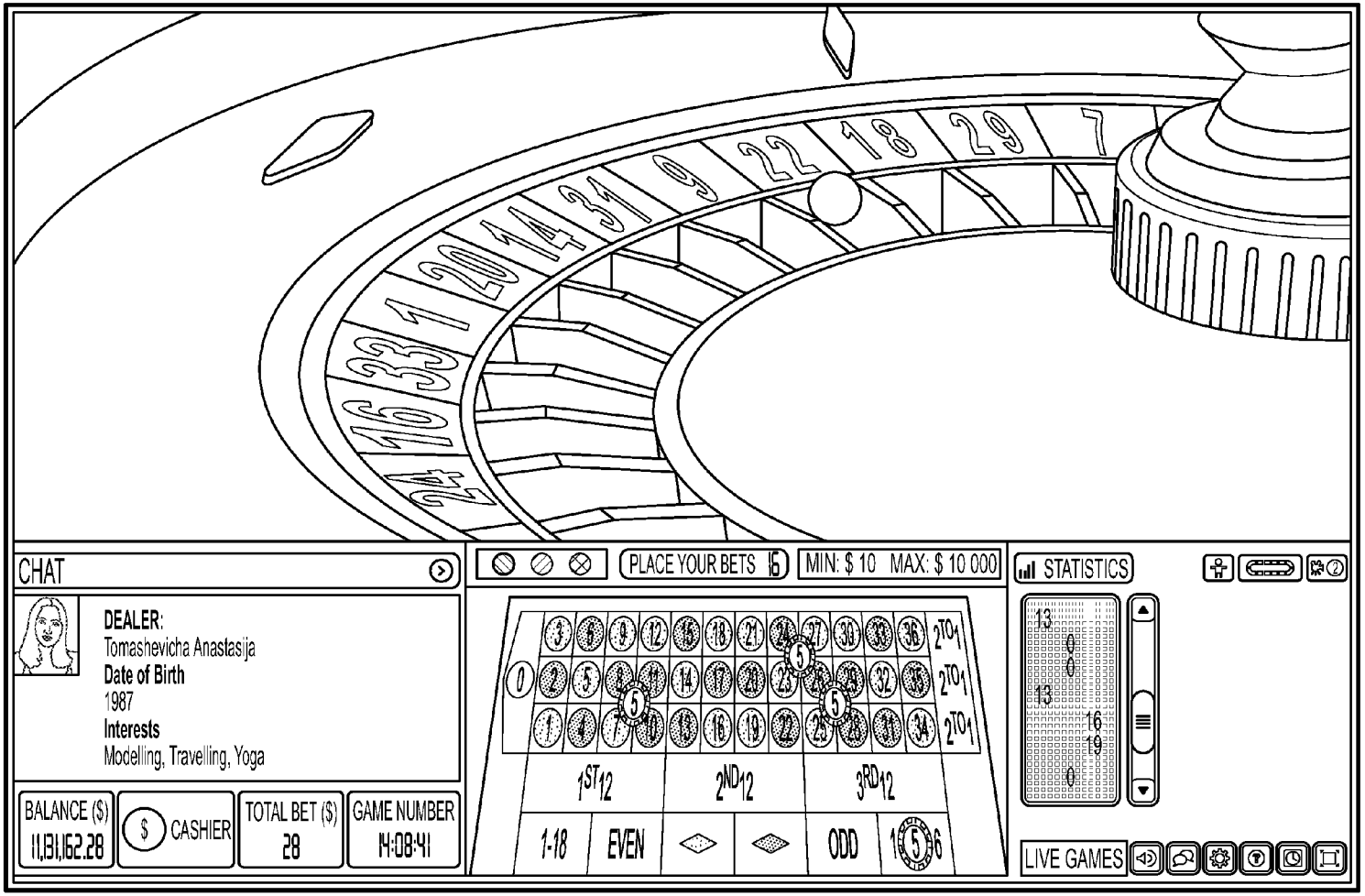
FIG. 4. shows an example of a user interface for presenting the movement of a ball during a roulette session in accordance with some embodiments of the disclosed subject matter.

In some embodiments, during the roulette session, the user device can present multiple interfaces (e.g., such as an interface 300 of FIG. 3 and an interface 400 of FIG. 4) to the user to allow the user to view the movement of the ball in a real-time manner. For example, as illustrated in FIG. 3, an interface 300 can be presented to the user to allow the user to browse information about the roulette session, information about the players who are participating in the roulette session, information about the dealer, information about previous roulette sessions, and/or any other suitable information. As another example, as illustrated in FIG. 4, interface 400 can present suitable video data (e.g., such as a set of moving images, etc.) showing the roulette wheel, the spinning ball, the dealer, etc. In some embodiments, the user device can receive a set of moving images of the roulette wheel, the spinning ball, etc. that are transmitted from a server. The user device can then cause the moving images to be displayed using interface 300 and/or interface 400.

In some embodiments, the moment when the ball is about to drop into a pocket on the roulette wheel can be detected (e.g., by comparing the speed of the ball with a suitable threshold). In some embodiments, suitable video effects, audio effects, etc. can be added to the video content and/or audio content rendered by the user device when the ball is about to drop into a pocket on the roulette. For example, as described below in more detail in connection with FIG. 5, suitable visual effects can be achieved by adding slow-motion effects (e.g., by taking moving images at a high fame rate), adding mood lighting effects (e.g., changing the color, brightness, and other characteristics of the lighting), emphasizing the movement of the ball while de-emphasizing the background (e.g., by using a shallow focus technique, using low depth of field imaging, etc.), adding chromakey effects, adding suitable blackout periods to the video data, etc. As another example, suitable audio effects can be used to add dramatic effects to the movement of the ball. More particularly, for example, such audio effects can be achieved by adding sounds of the movement of the ball, adding suitable music, changing the tempo of the music, adding instruments, etc.

Figure 5:
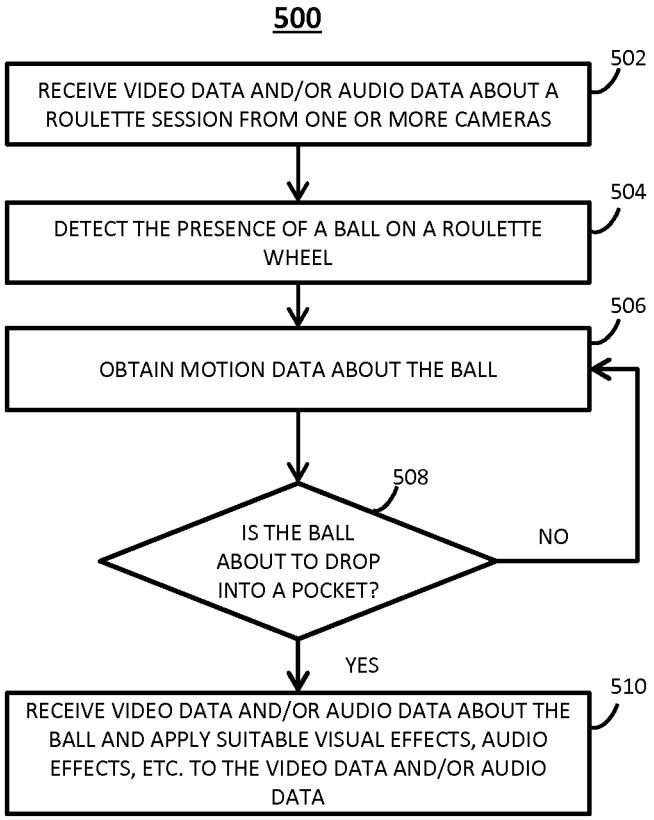
FIG. 5 shows an example of a process for implementing a roulette game system in accordance with some embodiments of the disclosed subject matter.

Turning to FIG. 5, an example 500 of a process for implementing a roulette game system is shown.

Figure 6:
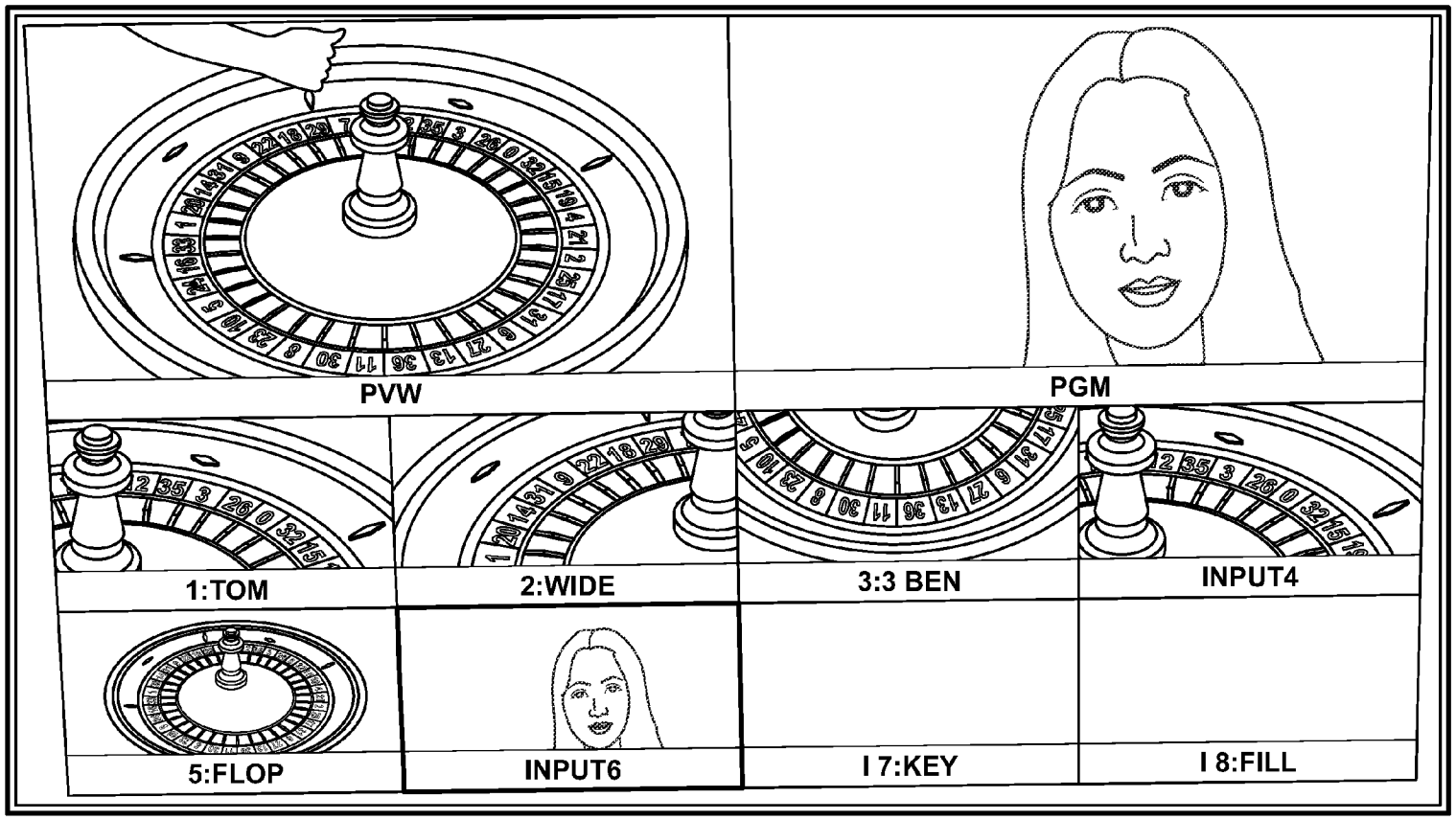
FIG. 6 shows an example of image data about a roulette session in accordance with some embodiments of the disclosed subject matter.

As illustrated, process 500 can begin by receiving video data and/or audio data about a roulette session from one or more cameras at 502. Any suitable cameras can be used and arranged in a suitable manner to obtain image data about the roulette session. For example, multiple cameras can be arranged to take still images and/or moving images of a roulette wheel, a roulette table, a dealer, etc. relating to the roulette session. In a more particular example, as shown in FIG. 6, each of the cameras can producing a video stream including moving images of any suitable portion of the roulette wheel, the roulette table, the dealer etc.

Figure 7:
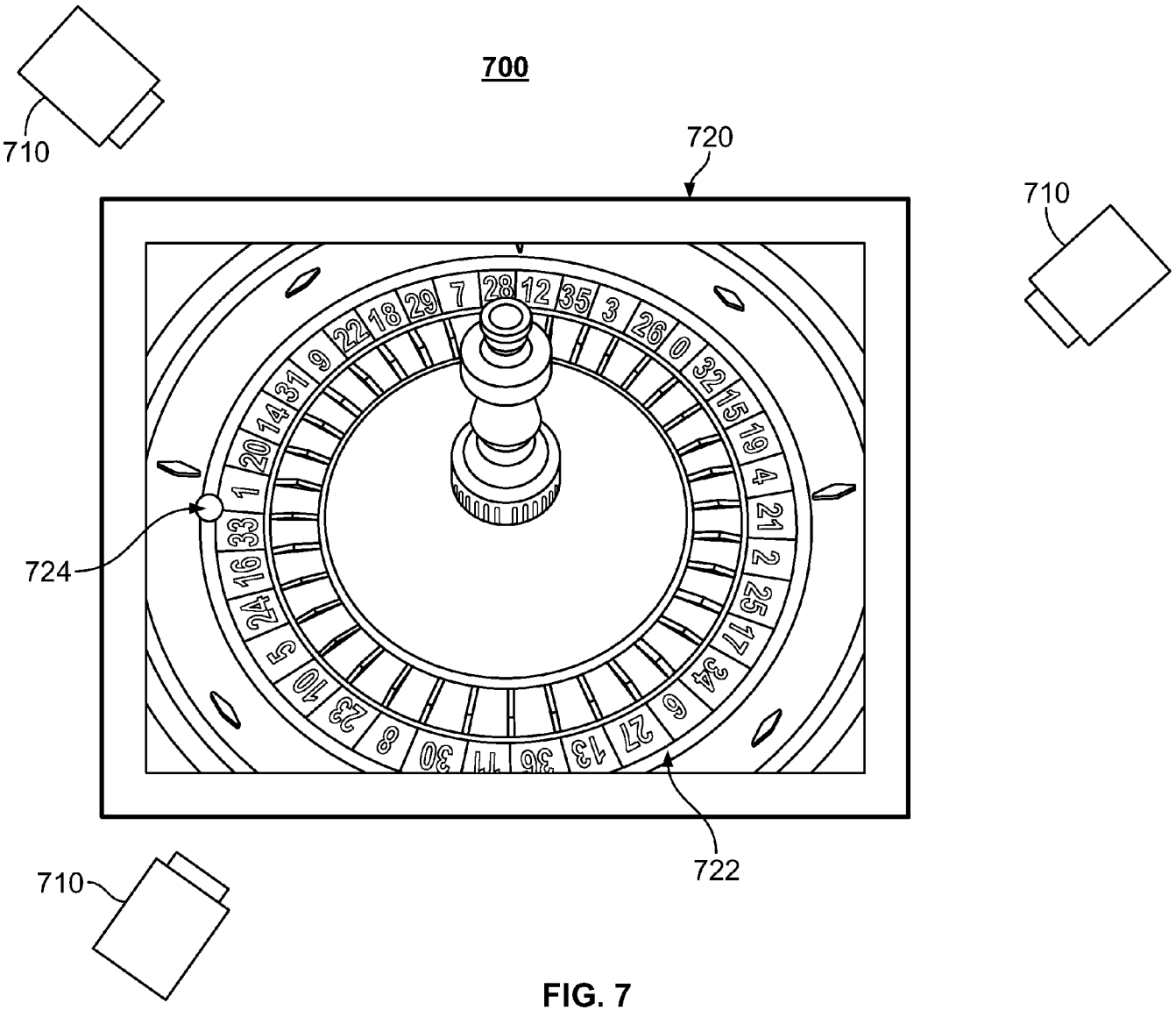
FIG. 7 shows an example of a system for obtaining image data about a roulette session in accordance with some embodiments of the disclosed subject matter.

In another more particular example, as shown in FIG. 7, one or more cameras 710 can monitor an area 720 that can include a roulette wheel 722 and a ball 724. In some embodiments, each of cameras 710 can have a suitable field of view (FOV) that can cover area 720 or a suitable portion of area 720. For example, in the example where multiple cameras 710 (e.g., three cameras or any suitable number of cameras) are used to monitor area 720, each of cameras 710 can have a FOV that covers a portion of area 720 (e.g., a FOV that is greater than 120-degree or any suitable FOV). Cameras 710 can be arranged so that the combination of their FOVs can have a 360-degree FOV that covers area 720. In some embodiments, each pair of adjacent cameras 710 can have overlapping FOVs.

Referring back to FIG. 5, at 504, process 500 can detect the presence of a ball on a roulette wheel. The presence of the ball can be detected in any suitable manner. For example, process 500 can process the received video data using one or more suitable image processing and/or analyzing algorithms, such as image segmentation, filtering, edge detection, foreground detection, etc. Process 500 can then identify the position of the ball in the processed image data. In a more particular example, process 500 can segment an image (e.g., a still image or a moving image contained in the video data produced by the cameras) into multiple areas containing multiple objects (e.g., such as the wheel, the ball, etc.) using suitable image segmentation and/or edge detection algorithms. Process 500 can then identify the area containing the ball based on the shape of the area, the size of the area, etc.

At 506, process 500 can obtain motion data about the ball. Any suitable motion data can be obtained in accordance with some embodiments. For example, the motion data can include a trajectory of the ball, one or more positions of the ball, the velocity of the ball at a particular time instant, one or more motion vectors relating to the movement of the ball, etc. The motion data can be obtained in any suitable manner. For example, in some embodiments, in response to identifying the ball in the image data, process 500 can track the ball in a set of moving images produced by the cameras to obtain motion data about the ball. In a more particular example, the position of the ball can be tracked based on one or more suitable object tracking algorithms, such as blob tracking, kernel-based tracking, contour tracking, visual feature matching, etc. In another more particular example, process 500 can calculate one or more motion vectors using the set of moving images, such as a set of motion vectors corresponding to the movement of the region containing the ball in the set of moving images, one or more global motion vectors, one or more motion vectors corresponding to the movement of the region containing the wheel, etc. Process 500 can then estimate the velocity of the ball at a particular time instant (e.g., using the directions and/or magnitudes of one or more motion vectors).

At 508, process 500 can determine whether the ball is about to drop into a pocket on the roulette wheel. The determination can be made in any suitable manner. For example, process 500 can make the determination based on the motion data obtained at 506. In a more particular example, process 500 can determine that the ball is about to drop on the wheel when the magnitude of the velocity (e.g., the speed of the ball) is less than a suitable threshold.

In some embodiments, in response to determining that the ball is not about to drop into a pocket on the roulette wheel, process 500 can loop back to step 506.

In some embodiments, in response to determining that the ball is about to drop into a pocket on the wheel, process 500 can capture and/or receive video data and/or audio data about the ball, and apply suitable visual effects, audio effects, etc. to the video data and/or audio data at 510. The video data can be captured and/or received in any suitable manner. For example, process 500 can estimate the movement of the ball and identify one or more cameras whose FOVs can cover the ball during its movement. Process 500 can then control the cameras to capture suitable video data and/or audio data about the movement of the ball. In a more particular example, process 500 can control one or more cameras to produce slow-motion images by operating at a high-speed mode and taking a set of moving images at a high rate (e.g., a rate higher than that the moving images will be played back).

As another example, process 500 can control one or more cameras to produce moving images that emphasize the movement of the ball while de-emphasizing other objects captured in the moving images (e.g., such as the roulette wheel, the dealer, etc.). More particularly, for example, a shallow focus technique (e.g., using low depth of field imaging) can be used to make a plane of the images (e.g., the plane that shows the movement of the ball) in focus and the rest of the images out of focus. In a more particular example, process 500 can change the depth of field of one or more cameras that capture moving images of the rolling ball by changing the focal lengths of the cameras, the apertures of the cameras, the positions of the cameras, etc.

As yet another example, process 500 can control one or more cameras, or select portions of images/video generated from one or more cameras, so that video data including a falling ball is controllably captured and/or presented with the ball located in different portions of the display over a window of time during which the ball falls. For example, in some embodiments, in video displayed to a user, the ball can first appear to be falling in the middle of the display, the display can then slowly pan to the right so that the ball is progressively located toward the left side of the display, the display can next slowly pan to the left so that ball is progressively located toward the right side of the display, and finally the display can slowly pan back to the right so that the ball is progressively located in the middle of the middle. Any suitable direction of panning, speed of panning, one or more locations for the ball during different points in panning, etc. can be used in some embodiments.

In some embodiments, any suitable visual effects, audio effects, etc. can be added to the video data about the spinning ball. For example, process 500 can apply a mood lighting effect to the video data. In a more particular example, process 500 can change the color, brightness, and/or other suitable characteristics of the lighting applied to the roulette wheel and/or the ball to create a suitable mood (e.g., such as a dramatic mood). As another example, process 500 can apply a chromakey effect to the video data. In a more particular example, process 500 can composite an image produced by the cameras with a pre-stored image to enhance the dramatic effect when the ball is falling in a pocket on the wheel, to identify the winning pocket, and/or to create any other suitable visual effects. As yet another example, process 500 can add suitable audio effects, such as sounds created by a falling ball, suitable music, change the tempo of the music, adding instructions, etc.

Figure 8:
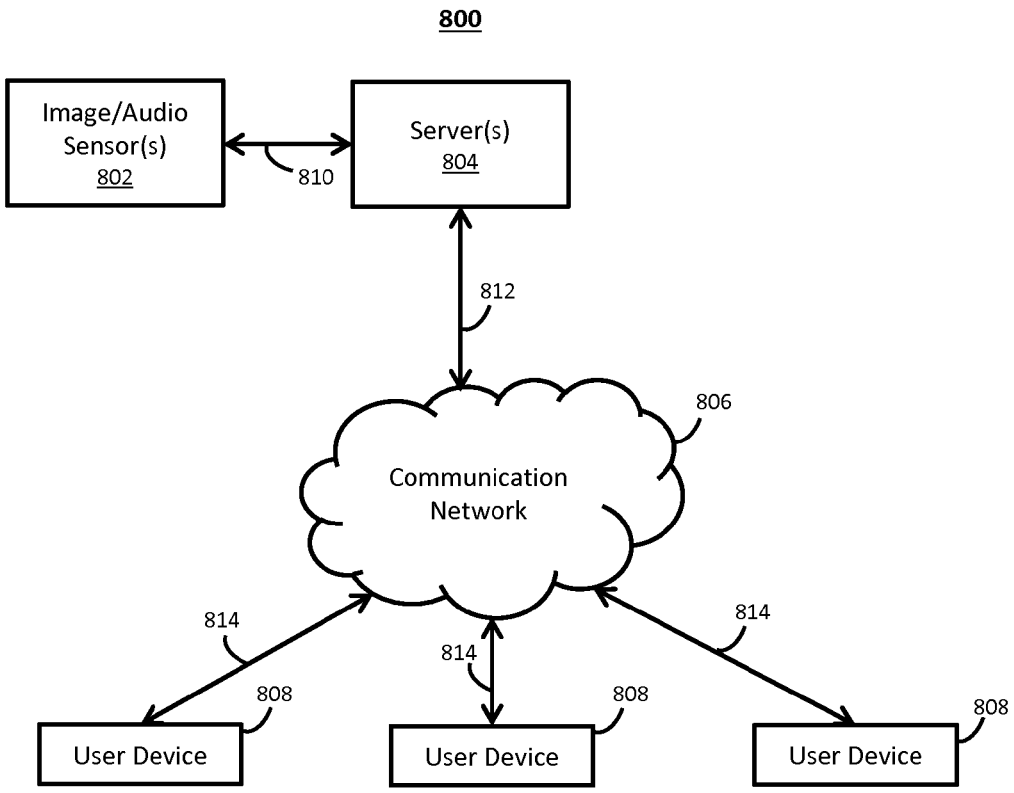
FIG. 8 shows a generalized block diagram of an example of a roulette gaming system in accordance with some implementations of the disclosed subject matter.

Turning to FIG. 8, a generalized block diagram of an example 800 of a roulette gaming system in accordance with some embodiments of the disclosed subject matter is shown. As illustrated, system 800 can include one or more image/audio sensors 802, one or more servers 804, a communication network 806, one or more user devices 808, and communication links 810, 812, and 814.

Image/audio sensor(s) 802 can include any suitable device that is capable of producing image data (e.g., such as still images, moving images, etc.) and/or audio data. In some embodiments, image/audio sensor(s) 802 can be or include a video camera, a stereo camera, a video recorder, a microphone, etc. In a more particular example, the image/audio sensor(s) 802 can include one or more high-speed cameras that are capable of taking still images and/or moving images of a moving object.

Server(s) 804 can be any suitable device that is capable of receiving, processing, and/or transmitting video data and/or audio data and/or performing any suitable functions. In some embodiments, one or more portions of, or all of process 500 as illustrated in FIG. 5 can be implemented by server(s) 804.

User device(s) 808 can be any suitable device that is capable of receiving, processing, and/or rendering video data and/or audio data or performing any suitable functions. In some embodiments, one or more interfaces illustrated in FIGS. 1-4 can be implemented by user device(s) 808. For example, user device(s) 808 can include a mobile phone, a tablet computer, a laptop computer, a desktop computer, a personal data assistant (PDA), a portable email device, a gaming device, and/or any other suitable device.

Although three user devices 808 are shown in FIG. 8 to avoid over-complicating the drawing, any suitable number of these devices, and suitable types of these devices, can be used in some implementations.

Each of image/audio sensor(s) 802, server(s) 804, and user device(s) 808 can include and/or be any of a general purpose device such as a computer or a special purpose device such as a client, a server, etc. Any of these general or special purpose devices can include any suitable components such as a hardware processor (which can be a microprocessor, digital signal processor, a controller, etc.), memory, communication interfaces, display controllers, input devices, etc. Moreover, each of image/audio sensor(s) 802, server(s) 804, and user device(s) 808 can comprise a storage device, which can include a hard drive, a solid state storage device, a removable storage device, and/or any other suitable storage device. Each of image/audio sensor(s) 802, server(s) 804, and user device(s) 808 can be located at any suitable location. Each of image/audio sensor(s) 802, server(s) 804, and user device(s) 808 can be implemented as a stand-alone device or integrated with other components of system 800.

Communications network 806 can be any suitable computer network such as the Internet, an intranet, a wide-area network ("WAN"), a local-area network ("LAN"), a wireless network, a digital subscriber line ("DSL") network, a frame relay network, an asynchronous transfer mode ("ATM") network, a virtual private network ("VPN"), a satellite network, a mobile phone network, a mobile data network, a cable network, a telephone network, a fiber optic network, and/or any other suitable communication network, or any combination of any of such networks.

Server(s) 804 and user device(s) 808 can be connected to communications network 806 through communication links 812 and 814, respectively. Server(s) 804 can be connected to camera(s) 802 through communication link 810. Communication links 810, 812, and 814 can be any suitable communication links, such as network links, dial-up links, wireless links, hard-wired links, any other suitable communication links, or a combination of such links.

In some implementations, any suitable computer readable media can be used for storing instructions for performing the processes described herein. For example, in some implementations, computer readable media can be transitory or non-transitory. For example, non-transitory computer readable media can include media such as magnetic media (such as hard disks, floppy disks, etc.), optical media (such as compact discs, digital video discs, Blu-ray discs, etc.), semiconductor media (such as flash memory, electrically programmable read only memory (EPROM), electrically erasable programmable read only memory (EEPROM), etc.), any suitable media that is not fleeting or devoid of any semblance of permanence during transmission, and/or any suitable tangible media. As another example, transitory computer readable media can include signals on networks, in wires, conductors, optical fibers, circuits, any suitable media that is fleeting and devoid of any semblance of permanence during transmission, and/or any suitable intangible media.

The provision of the examples described herein (as well as clauses phrased as "such as," "e.g.," "including," and the like) should not be interpreted as limiting the disclosed subject matter to the specific examples; rather, the examples are intended to illustrate only some of many possible aspects.

Accordingly, methods, systems, and media for immersive roulette gaming are provided.

Although the disclosed subject matter has been described and illustrated in the foregoing illustrative implementations, it is understood that the present disclosure has been made only by way of example, and that numerous changes in the details of implementation of the disclosed subject matter can be made without departing from the spirit and scope of the disclosed subject matter. Features of the disclosed implementations can be combined and rearranged in various ways.

What is claimed is:

1. A method for roulette gaming, the method comprising:

receiving video data from a plurality of image sensors that are facing a physical roulette wheel and a physical roulette ball, wherein the video data includes video of the physical roulette ball moving on the physical roulette wheel;

determining that the physical roulette ball is about to drop on the physical roulette wheel using a hardware processor;

producing, using the video of the physical roulette ball moving on the physical roulette wheel included in the video data received from the plurality of image sensors that are facing the physical roulette wheel and the physical roulette ball, multiple slow-motion images of the physical roulette ball as the physical roulette ball drops into a pocket on the physical roulette wheel in response to determining that the ball is about to drop on the roulette wheel;

producing video content by applying a plurality of visual effects to the video data in response to determining that the ball is about to fall into a pocket on the roulette wheel, wherein the plurality of visual effects comprises a chromakey effect; and causing the video content to be rendered by a user device.

2. The method of claim 1, wherein each of the plurality of image sensors has a field of view covering a portion of the roulette wheel.

3. The method of claim 1, further comprising:

estimating a velocity of the ball based on the video data; and determining that the ball is about to fall into the pocket on the roulette wheel when the magnitude of the velocity is less than a predetermined threshold.

4. The method of claim 1, further comprising producing moving images of the ball and the roulette wheel using a shallow focus technique.

5. The method of claim 1, further comprising:

producing audio content by adding a plurality of audio effects to the video data; and causing the audio content to be rendered by the user device in association with the video content.

6. A system for roulette gaming, the system comprising: at least one hardware processor that is configured to:

receive video data from a plurality of image sensors that are facing a physical roulette wheel and a physical roulette ball, wherein the video data includes video of the physical roulette ball moving on the physical roulette wheel;

determine that the physical roulette ball is about to drop on the physical roulette wheel;

produce, using the video of the physical roulette ball moving on the physical roulette wheel included in the video data received from the plurality of image sensors that are facing the physical roulette wheel and the physical roulette ball, multiple slow-motion images of the physical roulette ball as the physical roulette ball drops into a pocket on the physical roulette wheel in response to determining that the ball is about to drop on the roulette wheel;

produce video content by applying a plurality of visual effects to the video data in response to determining that the ball is about to fall into a pocket on the roulette wheel, wherein the plurality of visual effects comprises a chromakey effect; and cause the video content to be rendered by a user device.

7. The system of claim 6, wherein each of the plurality of image sensors has a field of view covering a portion of the roulette wheel.

8. The system of claim 6, wherein the at least one hardware processor is further configured to:

estimate a velocity of the ball based on the video data; and determine that the ball is about to fall into the pocket on the roulette wheel when the magnitude of the velocity is less than a predetermined threshold.

9. The system of claim 6, wherein the at least one hardware processor is further configured to produce moving images of the ball and the roulette wheel using a shallow focus technique.

10. The system of claim 6, wherein the at least one hardware processor is further configured to:

produce audio content by adding a plurality of audio effects to the video data; and cause the audio content to be rendered by the user device in association with the video content.

11. A non-transitory computer-readable medium containing computer executable instructions that, when executed by a processor, cause the processor to perform a method for roulette gaming, the method comprising:

receiving video data from a plurality of image sensors that are facing a physical roulette wheel and a physical roulette ball, wherein the video data includes video of the physical roulette ball moving on the physical roulette wheel;

determining that the physical roulette ball is about to drop on the physical roulette wheel;

producing, using the video of the physical roulette ball moving on the physical roulette wheel included in the video data received from the plurality of image sensors that are facing the physical roulette wheel and the physical roulette ball, multiple slow-motion images of the physical roulette ball as the physical roulette ball drops into a pocket on the physical roulette wheel in response to determining that the ball is about to drop on the roulette wheel;

producing video content by applying a plurality of visual effects to the video data in response to determining that the ball is about to fall into a pocket on the roulette wheel, wherein the plurality of visual effects comprises a chromakey effect; and causing the video content to be rendered by a user device.

12. The non-transitory computer-readable medium of claim 11, wherein each of the plurality of image sensors has a field of view covering a portion of the roulette wheel.

13. The non-transitory computer-readable medium of claim 11, wherein the method further comprises:

estimating a velocity of the ball based on the video data; and determining that the ball is about to fall into the pocket on the roulette wheel when the magnitude of the velocity is less than a predetermined threshold.

14. The non-transitory computer-readable medium of claim 11, wherein the method further comprises producing moving images of the ball and the roulette wheel using a shallow focus technique.

15. The non-transitory computer-readable medium of claim 11, wherein the method further comprises:

producing audio content by adding a plurality of audio effects to the video data; and causing the audio content to be rendered by the user device in association with the video content.

* * * * *